United States Patent [19]

Hanaoka et al.

[11] Patent Number: 4,856,477

[45] Date of Patent: Aug. 15, 1989

[54] THROTTLE CONTROL SYSTEM FOR AUTOMOTIVE INTERNAL COMBUSTION ENGINE WITH FAIL-SAFE MECHANISM

[75] Inventors: Motoyoshi Hanaoka, Tokyo; Akira Nakamura, Kanagawa, both of Japan

[73] Assignee: Nissan Motor Company, Limited, Yokohama, Japan

[21] Appl. No.: 222,573

[22] Filed: Jul. 21, 1988

[30] Foreign Application Priority Data

Jul. 24, 1987 [JP] Japan ..... 62-184964

[51] Int. Cl.[4] ..... F02D 11/10

[52] U.S. Cl. ..... 123/399; 123/400; 123/361; 180/197

[58] Field of Search ..... 123/399, 361, 400, 339; 180/197

[56] References Cited

U.S. PATENT DOCUMENTS 4,541,378 9/1985 Kitamura ..... 123/399
4,718,380 1/1988 Katayose et al. ..... 123/399
4,735,183 4/1988 Iaoue et al. ..... 123/399
4,747,380 5/1988 Ejiri et al. ..... 123/399
4,787,353 11/1988 Ishikawa et al. ..... 123/399

*Primary Examiner*—Raymond A. Nelli
*Attorney, Agent, or Firm*—Foley & Lardner, Schwartz, Jeffery, Schwaab, Mack, Blumenthal & Evans

[57] ABSTRACT

A throttle control system has means for coupling an accelerator position detector to a throttle servo system which drives a throttle valve to an angular position corresponding to the accelerator position detected by the accelerator position detector in normal mode throttle angle control. The system also has means for returning the throttle valve to an initial and fully closed position when operational force for the accelerator is released or when failure of the throttle servo system is detected. This throttle returning means is operable independently of the accelerator position detector in throttle returning operation for providing quicker response which is particularly required in fail-safe mode operation.

18 Claims, 3 Drawing Sheets

THROTTLE CONTROL SYSTEM FOR AUTOMOTIVE INTERNAL COMBUSTION ENGINE WITH FAIL-SAFE MECHANISM

BACKGROUND OF THE INVENTION

1. Field of the Invention

The present invention relates generally to a throttle control system for an automotive internal combustion engine, which controls a throttle valve angular position depending upon operational magnitude of an accelerator, such as an accelerator pedal, accelerator handle and so forth, through a electric or a hydraulic servo mechanism. More specifically, the invention relates to a throttle control system with a fail-safe mechanism which is durably perform fail-safe operation at the occurrence of failure in throttle control.

2. Description of the Background Art

One of the prior proposed throttle control system has been disclosed in Japanese Patent First (unexamined) Publication (Tokkai) Showa 59-190440. In this prior proposed system, an accelerator is connected to a detector which is designed to detect magnitude of operation of the accelerator to generate an electric command for driving a throttle valve, via a linkage, such as a linkage wire. The throttle valve is coupled with an electric servo mechanism including an electric motor which is responsive to the electric command for rotatingly driving throttle valve at an angular position corresponding to operation magnitude of the accelerator. The system is further provided with a throttle return mechanism for driving the throttle valve back to its initial position (fully closed position) in response to releasing of operational force on the accelerator. In the shown system, the throttle return mechanism is associated with the aforementioned linkage and, in turn, associated with a rotary shaft of the throttle for exerting force to return the throttle valve to the initial position. This throttle return mechanism also serves for performing fail-safe operation in response to occurrence of failure in the servo mechanism.

In such prior proposed throttle control system, a potentiometer has been used as the detector for detecting the stroke of the linkage and whereby detecting operation magnitude of the accelerator. The potentiometer is subject to secular variation resulting inaccuracy in monitoring the operation magnitude of the accelerator and, in turn, throttle valve angular position. In certain case, the secular variation may occur to increase internal resistance of the potentiometer, which resistance may interfere quick response to variation of the accelerator position to cause delay in production of the electric command ordering servo mechanism operation in a direction commanded through the accelerator. This clearly degrades the drivability of an automotive internal combustion engine. Furthermore, such delay will create certain difficulty in providing high response characteristics of fail-safe function.

SUMMARY OF THE INVENTION

Therefore, it is an object of the invention to provide a throttle control system which assure quick response in fail-safe operation irrespective of response charactristics of an accelerator position detecting means, such as a potentiometer.

In order to accomplish aforementioned and other objects, a throttle control system, according to the present invention, has means for coupling an accelerator position detector to a throttle servo system which drives a throttle valve to an angular position corresponding to the accelerator position detected by the accelerator position detector in normal mode throttle angle control. The system also has means for returning the throttle valve to an initial and fully closed position when operational force for the accelerator is released or when failure of the throttle servo system is detected. This throttle returning means is operable independently of the accelerator position detector in throttle returning operation for providing quicker response which is particularly required in fail-safe mode operation.

According to one aspect of the invention, a throttle control system for an automotive internal combustion engine, comprises a manually operable accelerator, a throttle servo actuator connected to a throttle valve shaft, to which a throttle valve is fixedly mounted, for driving the throttle valve shaft with the throttle valve to a desired angular position, an accelerator position detector means connected to the accelerator via a mechanical linkage for detecting position of the accelerator to produce an accelerator position indicative signal, a throttle control signal generator receiving the accelerator position indicative signal for deriving the desired angular position of the throttle valve and producing a throttle control signal for driving the throttle servo actuator to the position corresponding to the desired angular position, a mechanical means connected to the throttle valve shaft for mechanically driving the throttle valve toward fully closed initial position independently of the throttle control signal, and means, responsive to variation of the accelerator position in a direction commanding deceleration of the engine, for enabling the mechanical means active for driving the throttle valve shaft with the throttle valve for reducing throttle valve open angle at a magnitude corresponding to deceleration command independently of the accelerator position detector means.

In the practical construction, the mechanical means may comprise a movable member connected to the accelerator via a linkage and movable between a first position corresponding to the fully closed initial position of the throttle valve and a second position corresponding to a fully open position of the throttle valve according to position of the accelerator. In such case, the movable member serves as a stopper defining a maximum magnitude of angular displacement of the throttle valve shaft.

The means for making the mechanical means effective preferably comprise a first member movable with the accelerator between a first position corresponding to the fully closed initial position of the throttle valve and a second position corresponding to a fully open position of the throttle valve according to the position of the accelerator, a second member coupled with the accelerator position detector for transmitting magnitude of displacement of the first member for enabling the accelerator position detector to detect the accelerator position, coupling means for coupling the first and second members in response to variation of the accelerator position for commanding engine acceleration and decoupling the first and second members in response to variation of the accelerator commanding engine deceleration. The coupling means comprises a resilient means normally biasing the second member toward the first member.

In this case, the means for making the mechanical means effective, may be connected to the accelerator by the mechanical linkage in common to the accelerator position detector.

In the alternative, the throttle position detector is connected to the accelerator via a first mechanical wire and the mechanical means is connected to the accelerator via a second mechanical wire provided independently of the first mechanical wire, and the first and second mechanical wires are commonly connected to the accelerator by means of a common connecting member. In such case, the means for making the mechanical means effective, comprises a predetermined extra length of the first mechanical wire, which extra length of the first mechanical wire is designed for absorbing force to be exerted in a direction toward the first position and which reduces resistance for the mechanical means to operate the throttle valve in decelerating direction.

According to another aspect of the invention, a throttle control system for an automotive internal combustion engine, comprises a manually operable accelerator, a throttle servo actuator for driving the throttle valve to a desired angular position, an accelerator position detector means having a pivotal means connected to the accelerator via a mechanical linkage, for converting mechanical pivoting magnitude of the pivotal means, which pivoting magnitude corresponds to magnitude of displacement of the accelerator, into an electric accelerator position indicative signal having a value indicative of a position of the accelerator, a throttle control signal generator means receiving the accelerator position indicative signal for deriving the desired angular position of the throttle valve corresponding to the accelerator position, and producing a throttle control signal for driving the throttle valve to the desired position via the throttle servo actuator, and a mechanical means active in response to a deceleration demand input through the accelerator and indicative of desired deceleration magnitude, for mechanically driving the throttle valve for reducing open angle of the throttle valve at a magnitude corresponding to the desired deceleration magnitude irrespective of the accelerator position detector means.

DESCRIPTION OF THE PREFERRED EMBODIMENT

Figure 1:
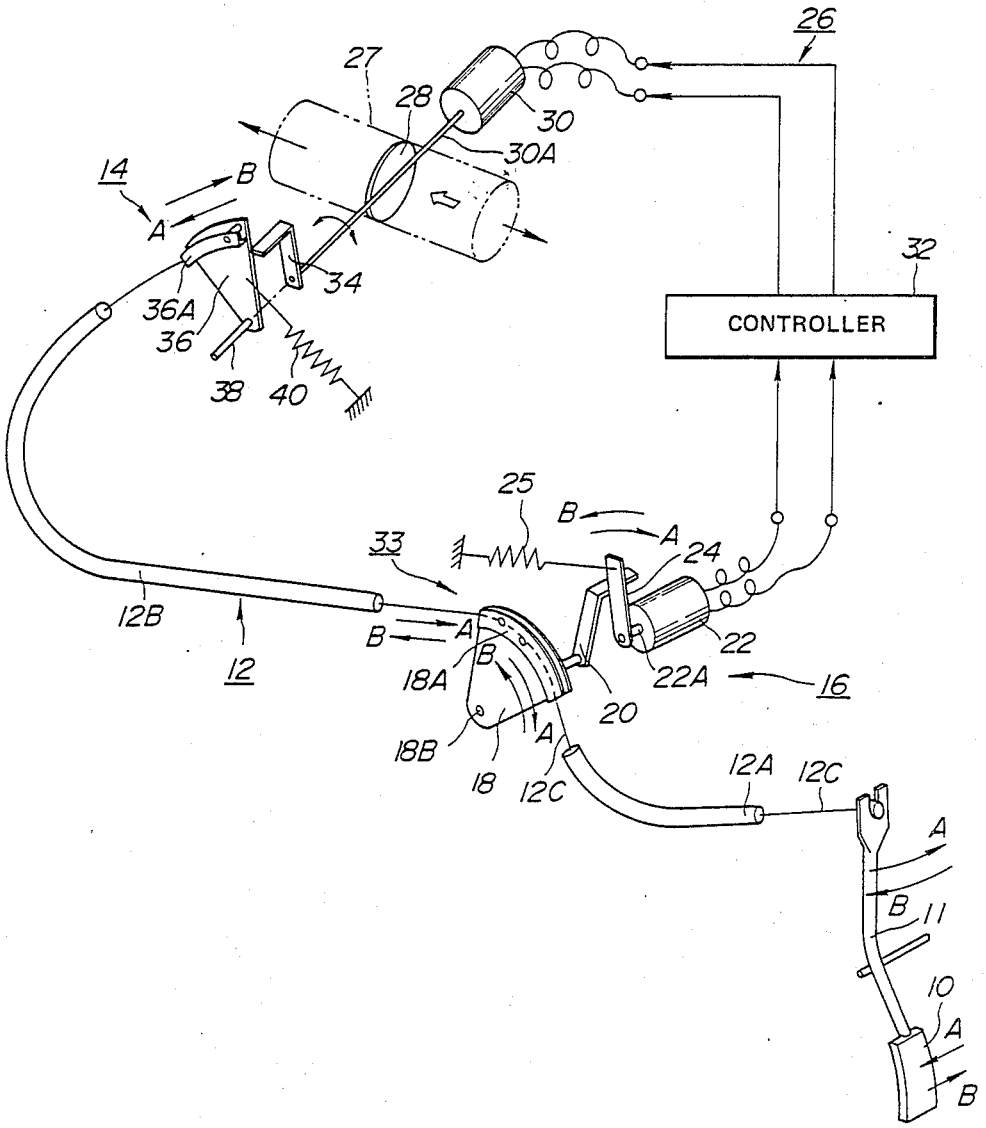
FIG. 1 is a diagramatical illustration of the first embodiment of a throttle control system according to the present invention.

Referring now to the drawings, the preferred embodiments of a throttle control system according to the present invention will be discussed herebelow with reference to the drawings for facilitating better understanding of the invention. It should be appreciated that the preferred embodiments illustrated in the accompanying drawings and discussed herebelow show examples for implementing the present invention, which, however, should not be taken to limit the invention to the specific embodiment but are for explanation and understanding only.

FIG. 1 shows a diagramatically illustrated circuitry of the first embodiment of a throttle control system according to the invention. As will be appreciated, the throttle control system performs adjustment of an angular position of a throttle valve 28 disposed in an air induction system 27 of an internal combustion engine according to operational command input through an accelerator 10 which comprises an accelerator pedal. As is well known, the accelerator pedal 10 is supported by means of an accelerator bracket 11 which is pivotably supported on a dash panel of a vehicle body. The accelerator bracket 11 supports the accelerator pedal 10 at one end. The other end of the accelerator bracket 11, which is located at opposite side across pivoting point, is formed into a bifurcated construction to receive a linkage wire which generally represented by the reference numeral 12. The linkage wire 12 is provided in a form of coaxial wire including a inner wire 12C and outer cylindrical tubes 12A and 12B. The linkage wire 12 extends across a pivotal intermediate drum 18 to a pivotal stopper drum 36. The intermediate drum 18 forms a part of an accelerator position detector 16.

The intermediate drum 18 is formed in an essentially fan shaped configuration and pivoted at the base portion for pivotal movement with rotational movement of a rotary shaft 18B. A L-shaped lever 20 is fixed to the rotary shaft 18B for pivotal movement according to rotation of the latter. The lever 20 is associated with a plane lever 24 which is fixed to an input shaft 22A of a potentiometer 22. The potentiometer 22 is designed for producing a voltage signal according to the angular position of the input shaft 22A, voltage of which voltage signal represents accelerator position.

The lever 24 is connected to one end of a bias spring 25. The other end of the bias spring 25 is connected to a vehicular body. The bias spring 25 is designed to normally bias the lever 24 toward the lever 20 for coupling the levers. As will be seen from FIG. 1, when the intermediate drum 18 pivots in a direction A which is a direction for increasing the throttle valve open angle, the levers 20 and 24 pivotally moves against the resilient force of the spring 25. On the other hand, when the intermediate drum 18 pivots in a direction B which is a direction for decreasing the throttle valve open angle toward fully closed position, the lever 20 becomes free from the resilient force of the spring 25 and thus becomes irrespective of the potentiometer 22. When the lever 20 pivots in a direction corresponding to the pivoting direction B of the intermediate drum 18, the lever 24 generally follows to the pivotal movement of the lever 20 by the resilient force of the spring 25.

The intermediate drum 18 is formed with a wire guide section 18A along the free peripheral edge. The inner wire 12C of the linkage wire 12 slides along the guide section 18A according to pivotal movement of the accelerator bracket 11. According to movement of the inner wire 12C, the intermediate drum 18 pivotally moves to pivotally drive the lever 20 via the rotary shaft 18B. Since the lever 24 is resiliently biased toward to lever 20 by means of the spring 25 for cooperation therewith, the pivotal movement of the lever 20 in a magnitude corresponding to stroke of the inner wire 12C is transmitted to the input shaft 22A of the potentiometer 22. Therefore, the potentiometer 22 outputs the voltage signal indicative of the accelerator position.

The accelerator position indicative voltage signal is fed to a controller 32 which is, in turn, connected to a throttle actuator 30 which comprises an electric motor. The electric motor 30 as the throttle actuator has a drive shaft 30A, to which the throttle valve 28 is fixed to be pivotally driven by rotation of the drive shaft. The drive shaft 30A extends across the air induction passage 27. An essentialy L-shaped lever 34 is fixed to the free end of the drive shaft 30A at the opposite side of the air induction passage relative to the electric motor 30. The lever 34 is thus pivotable according to rotation of the drive shaft 30A. The lever 34 is associated with the stopper drum 36 which is formed into essentialy fan shaped configuration and pivoted at the base portion for pivotal movement about a pivot 38. The stopper drum 36 has a side edge mating with the lever 34 and normally biased toward the lever 34 by means of a resilient spring 40. The stopper drum 36 has a guide section 36A to which the end of the inner wire 12C is rigidly connected.

Similarly to the constructions of the levers 20 and 24, the stopper drum 36 and the lever 34 are coupled in such a manner that when the throttle valve open angle is to be icreased, the stopper drum 36 pivots against the resilient force of the spring 40. Since the stopper drum 36 is connected to the accelerator bracket 11 via the inner wire 12C of the linkage wire 12, the angular position of the stopper drum always correspond to the accelerator position. On the other hand, the angular position of the lever 34 is purely controlled by the rotational driving force of the electric motor 30 via the drive shaft 30A and the lever. The pivotal movement of the lever 34 is restricted by the stopper drum 36 so that the lever 34 may not pivot beyond the accelerator position indicative stopper drum position. Therefore, throttle valve 28 may not be driven to provide extra air induction passage 27 beyond the accelerator bracket position. With this construction, when the driving command to drive the electric motor 30 ordering decreasing of the throttle valve open angle, the stopper drum 36 pivots in a direction B by the resilient force of the spring 40. This pivoting force of the stopper drum 36 serves to resiliently and forcingly drive the throttle valve 28 in a direction toward the fully closed position.

The stopper drum 36, the spring 40 and the lever 34 generally forms the throttle valve returning means 14 for forcingly drive the throttle valve 28 toward the fully closed position.

It should be noted that the spring force of the spring 40 is set much greater than the driving torque of the electric motor 30. This is advantageously taken so that the excessive magnitude of rotation of the drive shaft 30A which otherwise cause excessive open magnitude of throttle valve and extra angle of pivotal movement of the lever 34, can be successfully prevented. Furthermore, such force relationship between the spring 40 and the electric motor 30 is advantageous for facilitating quick response to deceleration demand which is input by decreasing depression magnitude on the accelerator pedal 10.

Figure 2:
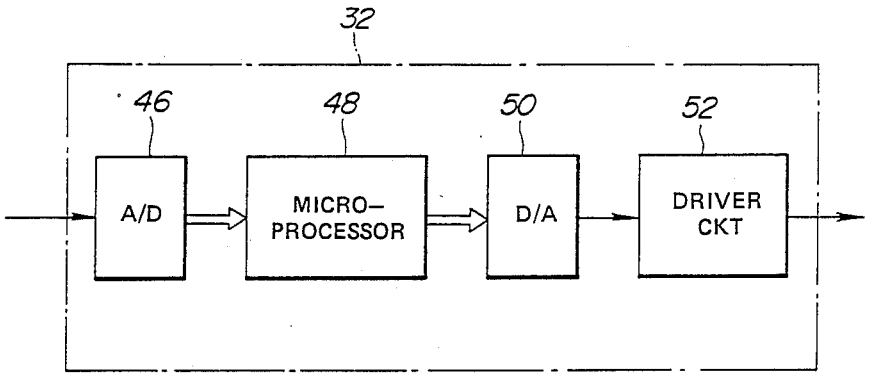
FIG. 2 is a schematic block diagram of a controller employed in the first embodiment of the throttle control system of FIG. 1.
Figure 3:
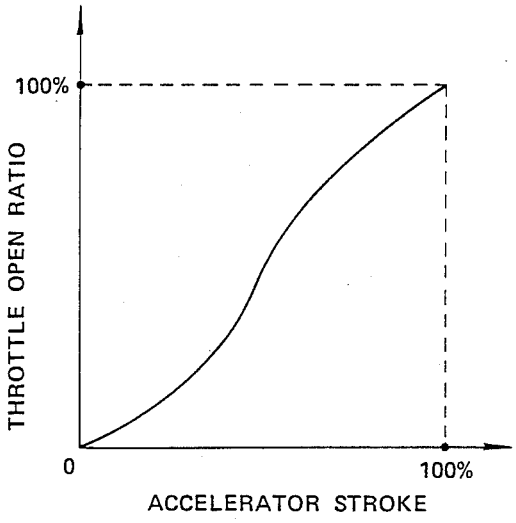
FIG. 3 is a chart showing variation of a throttle valve angular position relative to a position of an accelerator.

As shown in FIG. 2, the controller 32 comprises an analog-to-digital (A/D) converter 46 for converting the analog from voltage signal into a digital signal which is applicable for a digital processor, a microprocessor 48, a digital-to-analog (D/A) converter 50 for converting digital form throttle control signal output from the microprocessor into an analog voltage signal and a motor driver circuit 52. The microprocessor 48 is set a table of throttle open angle $\theta$ in relation to the accelerator pedal depression magnitude. The throttle open angle variation characteristics can be set in various patterns so as to obtain various engine acceleration characteristics. FIG. 3 shows one example of the throttle open angle variation characteristics for increasing throttle open angle according to increasing of the accelerator depression magnitude. Though the singular variation characteristics is examplified in FIG. 3, a plurality of throttle open angle variation characteristics can be set in the microprocessor 48 for selectively utilizing the desired one of characteristics.

In the practical control, the microprocessor 48 receives accelerator position indicative digital signal from the A/D converter 46 and performs table look-up to derive the corresponding throttle open angle $\theta$. The microprocessor 48 then produces a throttle control signal indicative of the throttle valve open angle. The throttle control signal in digital form is converted into the analog voltage signal by the D/A converter 50. The driver circuit 52 is responsive to the analog voltage signal from the D/A converter 50 to drive the electric motor 30 at a corresponding magnitude for setting the throttle valve 28 at a desired angular position.

For facilitate precise control of the throttle position, it may be desirable to constitute a feedback loop for feeding back a throttle position indicative signal to the microprocessor 48 so that the microprocessor may derive the throttle control signal based on the difference between the demanded throttle angular position which is derived in terms of the accelerator position indicative signal and the instantaneous throttle position indicated in the feedback signal. The instantaneous throttle position indicative signal may be provided by monitoring the driving magnitude of the electric motor or by integrating the driver signal output by the driver circuit. In the alternative, a throttle position signal which is produced by means of a known throttle angle sensor may be used as feedback signal representative of the instantaneous throttle position indicative data.

In the operation, the first embodiment of the throttle control system, according to the invention, is initially set at position shown in FIG. 1. At this position, the accelerator 10 is fully released. Therefore, the accelerator bracket 11 is placed at not pivoted initial position. Therefore, the linkage wire 12, the intermediate drum 18 and the stopper drum 36 are placed at initial positions. At this position, the throttle valve 28 is positioned at fully closed position to shut the air induction passage 27. As is well known, at this condition, the engine is maintained revolution at a minimum speed by intake air introduced through an auxiliary air passage (not shown).

By depressing the accelerator pedal 10 in a direction A for accelerating the engine, the accelerator bracket 11 pivots about pivot to shift the other end in the direction A to cause shifting of the inner wire 12C in the direction A at a magnitude of stroke corresponding to depression stroke of the accelerator pedal 10. By this the intermediate drum 18 and the stopper drum 36 are respectively pivoted in directions A.

According to pivotal movement of the intermediate drum 18, the levers 20 and 24 are driven in direction A against the spring force of the spring 25. By pivotal movement of the lever 24, the input shaft 22A of the potentiometer 22 is driven to rotate at the corresponding magnitude. The potentiometer 22 outputs the accelerator position indicative signal indicative of the accelerator pedal depression stroke to the controller 32.

Since the former throttle position is fully closed position, the microprocessor 48 derives the throttle control signal indicative of throttle valve open angle increasing magnitude. In response to the throttle control signal, the driver circuit 52 drives the electric motor 30 at the corresponding magnitude. Therefore, the throttle valve 28 is driven to the desired open angle position.

At the same time, the stopper drum 36 pivots in direction A against the spring 40. This allows the lever 34 pivot in throttle open direction and whereby allow the throttle valve 28 to be pivotally driven to the corresponding open angle position. Here, as set forth, since the stopper drum angular position is mechanically adjusted at the position determined by depression stroke of the accelerator pedal and thus defines the pivoting magnitude of the lever 34, excessive magnitude of motor drive which tends to occur when the potentiometer 22 or controller 32 malfunctions, will not cause excessive acceleration of the engine.

On the other hand, when the depression force to the accelerator pedal 10 is released for commanding engine deceleration, the accelerator bracket 11 pivots in direction B to cause shifting of the inner wire 12C of the linkage wire 12 in the corresponding stroke. This causes pivotal movement in directions B of the intermediate drum 18 and the stopper drum 36. At this time, since the lever 20 which is pivotal with the intermediate drum 18, becomes free from the lever 24 of the potentiometer 22. Therefore, the internal resistance in the potentiometer will never affect to returning of the inner wire 12C toward the initial position.

As long as the potentiometer operates in normal state, the lever 24 follows the lever 20 to pivotally move in direction B. Therefore, the accelerator position indicative voltage signal output from the potentiometer 22 become smaller than the former value. The microprocessor 48 in the controller 32 thus produces the throttle control signal to drive the electric motor 30 in a reverse direction to drive the throttle valve in closing direction.

At this time, since the force exerted on the stopper drum 36 by the accelerator pedal 10 via the inner wire 12C is reduced. The resilient force of the spring 40 becomes effective to pivotally drive the stopper drum 36 in direction B. This pivotal movement of the stopper drum 36 assists to cause pivotal movement of the throttle valve 28 toward closing direction. Namely, even when the electric motor 30 sticks to cause impossibility of driving the throttle valve in closing direction or when the potentiometer 22 or controller 32 fails so as not to output the control signal for driving the motor 30 in throttle closing direction, the stopper drum 36 successfully returns the throttle valve 28 to reduce the open angle thereof.

By the shown arrangement, since the throttle valve can be safely returned to the fully closed initial position even when the electric motor 30 or the potentiometer fails, the engine can be satisfactorily decelerated for assuring safety of driving. Furthermore, even when the potentiometer 22 lags in detection of the deceleration demand due to internal resistance which may cause delay of pivotal movement of the lever 24, quicker response to deceleration demand can be obtained by mechanically and forcingly drive the throttle valve to the desired smaller open angle position in response to reduction or releasing of the depression force to the accelerator pedal. This assures safety in driving of the vehicle. In addition, such arrangement is advantageously introduced in view of prevention of abnormal acceleration of the engine which otherwise be caused by failure of the potentiometer or the electric motor.

Additional advangate can be provided by the throttle control system according to the invention, that a required operational force for operating the accelerator becomes smaller because a resilient force of the spring 25 which normally bias the lever 24 of the potentiometer 22 to move synchroneously with the motion of the lever 20, will not serve as resistance for operating the accelerator in accelerating direction.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

Figure 4:
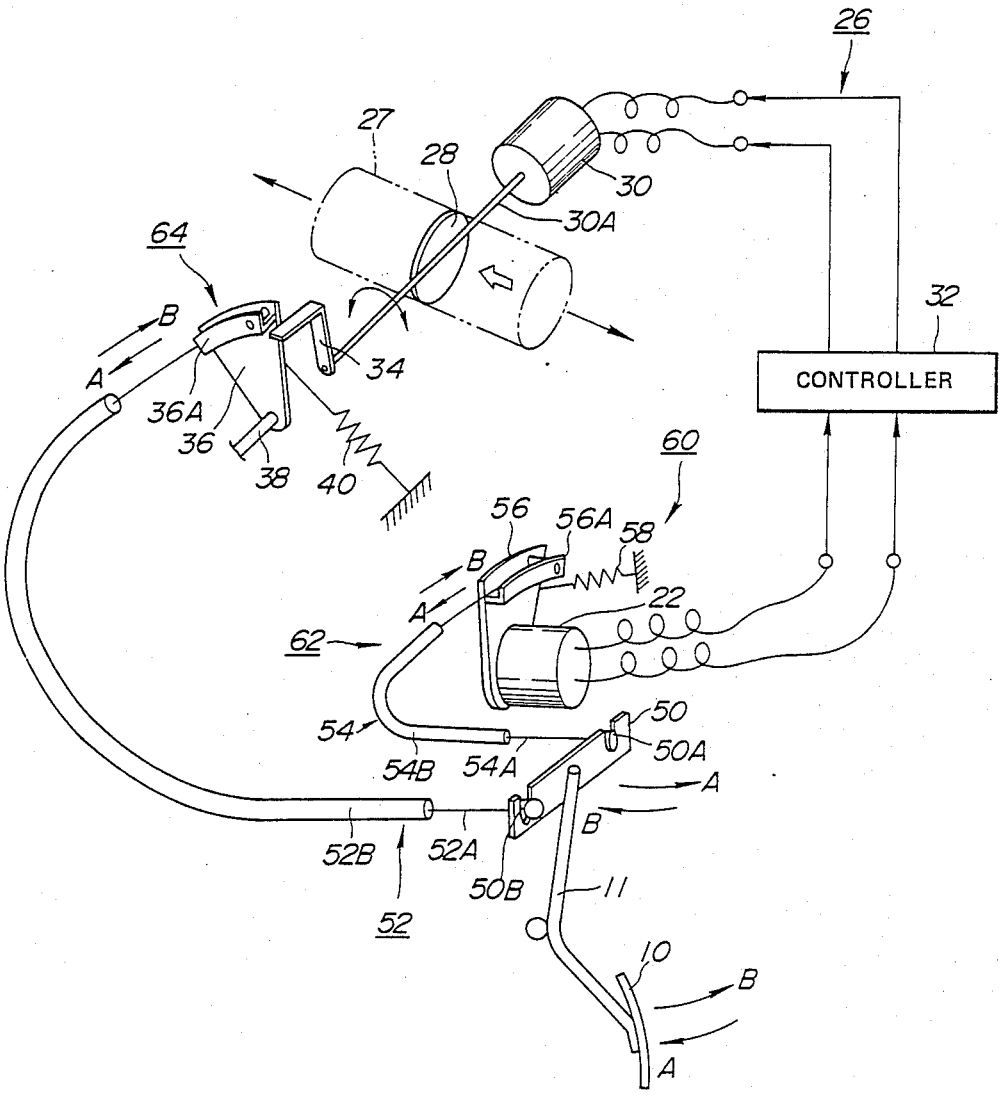
FIG. 4 is a diagramatical illustration of the second embodiment of a throttle control system according to the invention.

For example, the throttle control system according to the present invention can also be implemented by the construction illustrated in FIG. 4. In the following discussion with respect to another embodiment of the throttle control system of FIG. 4, the components which are common to the former embodiment will be represented by the same reference numerals and neglected detailed discussions in order to simplify the disclosure and for avoiding redundant recitation which possibly cause confusion.

This embodiment features independent drive of the stopper drum 36 and a potentiometer lever 56 via independently operable coaxial wires 52 and 54. This arrangement makes detection of the accelerator position and control of the stopper drum position independent of each other for effect equivalent to that obtained on the former embodiment.

In order to drive both of the coaxial wires 52 and 54, the accelerator bracket 11 carries a wire bracket 50 having engaging cut-outs 50A and 50B. The wire bracket 50 is fixed to the accelerator bracket 11 at the opposite side end of the accelerator pedal 10 in relation to the pivoting point. An inner wire 54A coaxially and slidingly disposed in an outer cylindrical tube 54B is connected to the cut-out 50A at one end and to a wire guide section 56A of the potentiometer lever 56. The potentiometer lever 56 is rigidly fixed to the input shaft of the potentiometer 22. The potentiometer lever 56 is biased by means of a bias spring 58 toward direction B which is the direction for pivoting when the throttle valve open angle is decreased. On the other hand, the coaxial wire 52 has an inner wire 52A and an outer cylindrical tube 52B. The inner wire 52A is connected to the cut-out 50B at one end and to the stopper drum 36.

As seen from FIG. 4, the coaxial wire 54 has a length longer than necessary length for connecting the accelerator bracket 11 to the potentiometer lever 56 with a predetermined extra length. This extra length is absorbed by bending as shown. This extra length of wire 54 allows quicker return of the wire 52 toward initial position when magnitude of depression of the accelerator pedal is reduced by the spring force of the return spring 40. Namely, when the potentiometer lever 56 lags to pivotally move in direction B in response to decreasing of the accelerator depression magnitude, the extra length of the wire 54 serves to absorb this lag which otherwise serve as resistance, and allows the wire 52 to stroke in direction B without stress.

In the operation, the shown embodiment of the throttle control system is initially positioned at a position shown in FIG. 4.

Similarly to the former embodiment, the accelerator 10 is fully released at this position and therefore, the accelerator bracket 11 is placed at not pivoted front the initial position. Therefore, the wires 52 and 54, the potentiometer lever 56 and the stopper drum 36 are placed at the initial positions. At this position, the throttle valve 28 is positioned at fully closed position to shut the air induction passage 27.

By depressing the accelerator pedal 10 in a direction A for accelerating the engine, the accelerator bracket 11 pivots about pivot to shift the other end with the wire bracket 50 in the direction A to cause shifting of the inner wires 52A and 54A in the directions A at a magnitude of stroke corresponding to depression stroke of the accelerator pedal 10. By this the potentiometer lever 56 and the stopper drum 36 are respectively pivoted in directions A.

According to pivotal movement of the potentiometer lever 56 is driven in direction A against the spring force of the spring 58. By pivotal movement of the potentiometer lever 56, the input shaft of the potentiometer 22 is driven to rotate at the corresponding magnitude. The potentiometer 22 outputs the accelerator position indicative signal indicative of the accelerator pedal depression stroke to the controller 32.

In response to the throttle control signal, the driver circuit 52 drives the electric motor 30 at the corresponding magnitude. Therefore, the throttle valve 28 is driven to the desired open angle position.

At the same time, the stopper drum 36 pivots in direction A against the spring 40. This allows the lever 34 pivot in throttle open direction and whereby allow the throttle valve 28 to be pivotally driven to the corresponding open angle position. Here, as set forth, since the stopper drum angular position is mechanically adjusted at the position determined by depression stroke of the accelerator pedal and thus defines the pivoting magnitude of the lever 34, excessive magnitude of motor drive which tends to occur when the potentiometer 22 or controller 32 malfunctions, will not cause excessive acceleration of the engine.

On the other hand, when the depression force to the accelerator pedal 10 is released for commanding engine deceleration, the accelerator bracket 11 pivots in direction B to cause shifting of the inner wires 52A and 54A of the wires 52 and 54 in the corresponding stroke. This causes pivotal movement in directions B of the potentiometer lever 56 and the stopper drum 36. At this time, since the wire 54 is provided extra length, quick return of the throttle valve 28 by the resilient force of the return spring 40 without any stress which may otherwise created by internal resistance of the potentiometer 22.

What is claimed is:

1. A throttle control system for an automotive internal combustion engine, comprising:

a manually operable accelerator;

a throttle servo actuator connected to a throttle valve shaft, to which a throttle valve is fixedly mounted, for driving said throttle valve shaft with said throttle valve to a desired angular position;

an accelerator position detector means connected to said accelerator via a mechanical linkage for detecting position of said accelerator to produce an accelerator position indicative signal;

a throttle control signal generator receiving said accelerator position indicative signal for deriving said desired angular position of said throttle valve and producing a throttle control signal for driving said throttle servo actuator to the position corresponding to said desired angular position;

a mechanical means connected to said throttle valve shaft for mechanically driving said throttle valve toward fully closed initial position independently of said throttle control signal; and means, responsive to variation of said accelerator position in a direction commanding deceleration of the engine, for enabling said mechanical means active for driving said throttle valve shaft with said throttle valve for reducing throttle valve open angle at a magnitude corresponding to deceleration command, independently of said accelerator position detector means.

2. A throttle control system as set forth in claim 1, wherein said mechanical means comprises a movable member connected to said accelerator via a linkage and movable between a first position corresponding to said fully closed initial position of said throttle valve and a second position corresponding to a fully open position of said throttle valve according to position of said accelerator.

3. A throttle control system as set forth in claim 2, wherein said movable member serves as a stopper defining a maximum magnitude of angular displacement of said throttle valve shaft.

4. A throttle control system as set forth in claim 1, wherein said means for making said mechanical means effective comprises a first member movable with said accelerator between a first position corresponding to said fully closed initial position of said throttle valve and a second position corresponding to a fully open position of said throttle valve according to the position of said accelerator, a second member coupled with said accelerator position detector for transmitting magnitude of displacement of said first member for enabling said accelerator position detector to detect said accelerator position, coupling means for coupling said first and second members in response to variation of said accelerator position for commanding engine acceleration and decoupling said first and second members in repsonse to variation of said accelerator commanding engine deceleration.

5. A throttle control system as set forth in claim 4, wherein said coupling means comprises a resilient means normally biasing said second member toward said first member.

6. A throttle control system as set forth in claim 3, wherein said means for making said mechanical means effective comprises a first member movable with said accelerator between a first position corresponding to said fully closed initial position of said throttle valve and a second position corresponding to said fully open position of said throttle valve according to the position of said accelerator, a second member coupled with said accelerator position detector for transmitting magnitude of displacement of said first means for enabling said accelerator position detector to detect said accelerator position, coupling means for coupling said first and second members in response to variation of said accelerator position for commanding engine acceleration and decoupling said first and second members in response to variation of said accelerator commanding engine deceleration.

7. A throttle control system as set forth in claim 6, wherein said coupling means comprises a resilient means normally biasing said second member toward said first member.

8. A throttle control system as set forth in claim 7, wherein said means for making said mechanical means effective, is connected to said accelerator by said mechanical linkage in common to said accelerator position detector.

9. A throttle control system as set forth in claim 1, wherein said throttle position detector is connected to said accelerator via a first mechanical wire and said mechanical means is connected to said accelerator via a second mechanical wire provided independently of said first mechanical wire, and said first and second mechanical wires are commonly connected to said accelerator by means of a common connecting member.

10. A throttle control system as set forth in claim 9, wherein said means for making said mechanical means effective, comprises a predetermined extra length of said first mechanical wire, which extra length of said first mechanical wire is designed for absorbing force to be exerted in a direction toward said first position and which reduces resistance for said mechanical means to operate said throttle valve in decelerating direction.

11. A throttle control system for an automotive internal combustion engine, comprising:

a manually operable accelerator;

a throttle servo actuator for driving said throttle valve to a desired angular position;

an accelerator position detector means having a pivotal means connected to said accelerator via a mechanical linkage, for converting mechanical pivoting magnitude of said pivotal means, which pivoting magnitude corresponds to magnitude of displacement of said accelerator, into an electric accelerator position indicative signal having a value indicative of a position of said accelerator;

a throttle control signal generator means receiving said accelerator position indicative signal for deriving said desired angular position of said throttle valve corresponding to said accelerator position, and producing a throttle control signal for driving said throttle valve to said desired position via said throttle servo actuator;

a mechanical means active in response to a deceleration demand input through said accelerator and indicative of desired deceleration magnitude, for mechanically driving said throttle valve for reducing open angle of said throttle valve at a magnitude corresponding to said desired deceleration magnitude irrespective of said accelerator position detector means.

12. A throttle control system as set forth in claim 11, wherein said mechanical means comprises a movable member connected to said accelerator via a linkage and movable between a first position corresponding to said fully closed initial position of said throttle valve and a second position corresponding to a fully open position of said throttle valve according to position of said accelerator.

13. A throttle control system as set forth in claim 12, wherein said movable member serves as a stopper defining a maximum magnitude of angular displacement of said throttle valve shaft.

14. A throttle control system as set forth in claim 11, wherein said mechanical linkage connecting said accelerator and said accelerator position detector means comprises a first member movable with said accelerator between a first position corresponding to said fully closed initial position of said throttle valve and a second position corresponding to a fully open position of said throttle valve according to the position of said accelerator, a second member coupled with said accelerator position detector for transmitting magnitude of displacement of said first means for enabling said accelerator position detector to detect said accelerator position, coupling means for coupling said first and second members in response to variation of said accelerator position for commanding engine acceleration and decoupling said first and second members in response to variation of said accelerator commanding engine deceleration.

15. A throttle control system as set forth in claim 14, wherein said coupling means comprises a resilient means normally biasing said second member toward said first member.

16. A throttle control system as set forth in claim 15, wherein said mechanical means is connected to said accelerator by said mechanical linkage in common to said accelerator position detector.

17. A throttle control system as set forth in claim 11, wherein said throttle position detector is connected to said accelerator via a first mechanical wire and said mechanical means is connected to said accelerator via a second mechanical wire provided independently of said first mechanical wire, and said first and second mechanical wires are commonly connected to said accelerator by means of a common connecting member.

18. A throttle control system as set forth in claim 9, wherein said first mechanical wire is provided a predetermined extra length which is designed for absorbing force to be exerted in a direction toward said first position and which reduces resistance for said mechanical means to operate said throttle valve in decelerating direction.

* * * * *